US010063980B2

(12) United States Patent
Rosenkranz et al.

(10) Patent No.: US 10,063,980 B2
(45) Date of Patent: Aug. 28, 2018

(54) METHOD FOR IMPROVING A PICKED-UP SIGNAL IN A HEARING SYSTEM AND BINAURAL HEARING SYSTEM

(71) Applicant: SIVANTOS PTE. LTD., Singapore (SG)

(72) Inventors: Tobias Daniel Rosenkranz, Erlangen (DE); Homayoun Kamkar-Parsi, Erlangen (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 127 days.

(21) Appl. No.: 15/179,297

(22) Filed: Jun. 10, 2016

(65) Prior Publication Data

US 2016/0366523 A1 Dec. 15, 2016

(30) Foreign Application Priority Data

Jun. 10, 2015 (DE) ..... 10 2015 210 652

(51) Int. Cl.
*H04R 25/00* (2006.01)
*G10L 25/78* (2013.01)

(52) U.S. Cl.
CPC ..... *H04R 25/552* (2013.01); *H04R 25/305* (2013.01); *H04R 25/405* (2013.01); *H04R 25/407* (2013.01); *G10L 25/78* (2013.01); *H04R 2225/41* (2013.01); *H04R 2225/43* (2013.01)

(58) Field of Classification Search
CPC ..... G10L 25/78; H04R 25/305; H04R 25/405; H04R 25/407; H04R 25/552; H04R 2225/41; H04R 2225/43
See application file for complete search history.

(56) References Cited

U.S. PATENT DOCUMENTS 6,449,593 B1 9/2002 Valve
7,853,031 B2 12/2010 Hamacher
8,462,969 B2 6/2013 Claussen et al.
8,873,779 B2 * 10/2014 Lugger ..... H04R 25/00 381/312
9,124,986 B2 9/2015 Pedersen
(Continued)

FOREIGN PATENT DOCUMENTS

DE 60022304 T2 6/2006
DE 102005032274 A1 1/2007
(Continued)

*Primary Examiner* — Brian Ensey
(74) *Attorney, Agent, or Firm* — Laurence A. Greenberg; Werner H. Stemer; Ralph E. Locher

(57) ABSTRACT

A method improves a picked-up signal in a hearing system. The hearing system has at least one hearing device, particularly a hearing aid. The hearing aid device has an associated first directional microphone that has an adjustable first directional characteristic with a preferential direction. The first directional microphone converts sound into a first signal that is adopted in the picked-up signal. A speech activity of a user of the hearing system is monitored, and recognition of a speech activity of the user prompts the preferential direction of the first directional characteristic to be adjusted in comparison with a frontal direction of the user such that the sound sensitivity of the first directional microphone undergoes attenuation in the frontal direction.

20 Claims, 4 Drawing Sheets

(56) References Cited

U.S. PATENT DOCUMENTS

| | | | | |
|---|---|---|---|---|
| 2007/0098192 | A1* | 5/2007 | Sipkema | G02C 11/06 381/312 |
| 2012/0189147 | A1 | 7/2012 | Terada et al. | |
| 2016/0234609 | A1* | 8/2016 | Bendsen | H04R 25/407 |

FOREIGN PATENT DOCUMENTS

| | | | |
|---|---|---|---|
| DE | 102011087984 | A1 | 6/2013 |
| EP | 2381702 | A2 | 10/2011 |
| EP | 2541973 | A1 | 1/2013 |

* cited by examiner

METHOD FOR IMPROVING A PICKED-UP SIGNAL IN A HEARING SYSTEM AND BINAURAL HEARING SYSTEM

CROSS-REFERENCE TO RELATED APPLICATION

This application claims the priority, under 35 U.S.C. § 119, of German application DE 10 2015 210 652.7, filed Jun. 10, 2015; the prior application is herewith incorporated by reference in its entirety.

BACKGROUND OF THE INVENTION

Field of the Invention

The invention relates to a method for improving a picked-up signal in a hearing system having at least one hearing device, particularly a hearing aid. The at least one hearing device has an associated first directional microphone that has an adjustable first directional characteristic having a preferential direction, and the first directional microphone converts sound into a first signal that is adopted in the picked-up signal.

For a hearing aid, reception of one's own voice by the user plays a particularly important part, since subjective awareness of one's own voice, as perceived when wearing the hearing device, significantly influences acceptance of a hearing aid by the user. In this case, perception of one's own voice is firstly influenced by the signal path of the hearing aid, that is to say via pickup of the voice by the microphone system, appropriate signal processing of the microphone signal in a hearing aid and reproduction by the loudspeaker or generally the electro acoustic transducer of the hearing aid, with the sound produced being supplied directly to the ear of the user.

Secondly, a sound conductor provided for this supply—be it an ear mold of a "behind the ear" instrument (BTE) or be it the output of an "in the ear" or "completely in the canal" instrument (ITE or CIC)—usually causes extensive closure of the auditory canal, which can result in an occlusion effect for a speech activity of the user. This occurs primarily as a result of sound waves from one's own voice, which are routed by body-borne sound transmission primarily via the jaw bone to the auditory canal, and, owing to the closure of the auditory canal, cannot escape to the outside, which means that one's own voice when speaking is perceived as dull-sounding.

Whereas problems in the perception of one's own voice that are based on an occlusion effect are often countered by additional mechanical ventilation channels in the hearing aid or, more recently, also by special algorithms in the signal processing, the problems with the sound of the voice that are induced in the single path usually involve attempts to improve perception of the user's own voice by adaptive signal processing. By way of example, many hearing aids use automatic gain control (AGC), the gain of which can be lowered in the relevant frequency ranges for this purpose when recognizing the user's own speech activity. Similarly, a compression ratio, the threshold or the response times of compression ("compression ratio", "threshold", "attack/release") can be adapted for recognizing speech activity. Such recognition of the user's own speech activity is possible quickly and efficiently in this case.

However, such measures in the signal processing influence the entire signal component, at least in the relevant frequency ranges, as appropriate, and hence alter the signal components in frequency ranges essential to realistic voice reproduction by lowering the gain or altering the compression parameters. The acoustic perception of the surroundings is also affected thereby, which can be perceived as unpleasant particularly in lively conversation situations with multiple interlocutors. This can thus impair auditory perception significantly.

Published, non-prosecuted German patent application DE 10 2005 032 274 A1 discloses a hearing apparatus and a corresponding method for detection of the user's own voice. In this regard, a first microphone for picking up ambient sound and a second microphone for picking up auditory canal sound are provided. From a comparison of the signals from a first microphone and the second microphone, it is inferred that the user of the hearing device is speaking and its own voice is present. When the presence of his own voice is established, a directional microphone, in particular, is deactivated. In this way, the directional microphone is operated in an interference-free manner, since the directional microphone would undesirably always orient itself to the frontal direction if the user's own voice were present.

Published, non-prosecuted German patent application DE 10 2011 087 984 A1 proposes, for the purpose of recognizing the user's own voice, a hearing apparatus that contains at least two independent analysis devices, each of which is configured to take and receive audio signal as a basis for obtaining speech activity data that are dependent on the speaker activity of the wearer of the hearing apparatus. A fusion device is configured to receive the speech activity data from the analysis devices and to take the speech activity data as a basis for recognizing whether or not the wearer is currently speaking.

SUMMARY OF THE INVENTION

The invention is based on the object of specifying a method that, in a hearing system having at least one hearing device, is intended to improve the sound of a picked-up signal for the further processing, particularly in respect of perception by a user, as simply and efficiently as possible when there is voice activity.

The invention achieves the cited object by a method for improving a picked-up signal in a hearing system having at least one hearing device, particularly a hearing aid. The at least one hearing aid device has an associated first directional microphone that has an adjustable first directional characteristic having a preferential direction and the first directional microphone converts sound into a first signal that is adopted in the picked-up signal. A speech activity of a user of the hearing system is monitored, and recognition of a speech activity of the user prompts the preferential direction of the first directional characteristic to be adjusted in comparison with a frontal direction of the user such that the sound sensitivity of the first directional microphone undergoes attenuation in the frontal direction.

Embodiments that are advantageous and in some cases inventive in themselves are the subject matter of the sub claims and the description that follows.

In particular, the first directional microphone is formed by a plurality of, in particular, spaced single microphones, the first directional characteristic being formed by a superimposition of the directional characteristics of the single microphones. In this case, the single microphones may each have an essentially omnidirectional characteristic. In particular, the directional characteristic results from appropriate signal processing of the signals from the single microphones. In this case, the invention contains, in a binaural hearing system, particularly the preferred variant wherein one of the single microphones forming the first directional microphone is arranged in one, in that case the first, hearing device and wherein another of these single microphones is arranged in a further, second hearing device. In the case of a single hearing device, the first directional microphone is formed by arranging preferably two or more essentially omnidirectional single microphones together in the then one hearing device.

In this case, the picked-up signal is intended to be understood to mean that signal in which the first signal from the first directional microphone, into which a sound from the surroundings is converted with the spatial sensitivity prescribed by the selected directional characteristic, is adopted for further signal processing. In this case, the preferential direction of the first directional characteristic is intended to be understood to mean that spatial direction in which the first directional microphone has the highest sensitivity in this case, that is to say that in the case of a sound at constant level that hits the first directional microphone from different directions, arrival from the preferential direction prompts the highest signal level to be produced in the first signal.

Preferably, the first directional characteristic has axial or mirror symmetry, the preferential direction being situated on the access of symmetry or in the plane of symmetry. In this case, the frontal direction of the user is defined by the line of vision of its head, which runs parallel to the plane of symmetry of the head. Preferably, when the hearing device is worn properly by the user, the first directional characteristic can be set in relation to the frontal direction of the user. The first directional characteristic can have preferably a monotonous decrease in sound sensitivity in an angle range around the preferential direction, so that the attenuation in the sound sensitivity is achieved in the frontal direction for an adjustment by an increase in the angle between the preferential direction and the frontal direction.

In this context, the invention is first of all based on the consideration that any regulation or correction of the user's own voice in a picked-up signal, which is accomplished only by the AGC or by adaptation of the parameters for the compression, also has effects on the perception of the sound from the surroundings. Specifically in a hearing situation in which the user is conducting a lively conversation with one or else more interlocutors, and the interaction in the conversation means that the user's own voice activity can occasionally also coincide with a useful signal formed by the speech of one of the interlocutors, this would result in rapid changes in the volume and/or dynamics of the useful signal formed by the speech of the interlocutor, and also for the sound from the surroundings.

The invention makes use, then, of the empirically determinable circumstance that the diffraction of the sound that leaves the mouth during speech activity means that the sound of the user's own voice that the user perceives at one ear is essentially perceived as coming from the frontal direction. This means that, owing to the fact that the line of vision and hence the frontal direction of the user is oriented toward an interlocutor in most hearing situations formed by a conversation, the direction from which the useful signal provided by the speech activity of the interlocutor is perceived essentially coincides with the direction from which the user's own voice is perceived while speaking, provided that no further adaptation of the directions of perception is performed. The effect that can therefore be achieved by adjusting the preferential direction of the first directional characteristic in comparison with the frontal direction of the user is that a smaller proportion of the user's own voice is adopted in the picked-up signal. For agreeable auditory perception of the user's own voice, attenuation in relation to the signal processing of other useful signals of between 6 dB and 10 dB is usually sufficient in the signal path. If the first directional characteristic has a monotonous decrease in the sound sensitivity away from the preferential direction, then a moderate difference between the preferential direction of the first directional characteristic and the frontal direction is sufficient for attenuation of the picked-up speech signal from the user by between 6 dB and 10 dB.

This furthermore results in background noise, which cannot be explicitly associated with a clear source in special terms, not undergoing substantial attenuation owing to the cited measure, which means that the measures do not lead to undesirable fluctuations in the level of the background noise in the picked-up signal that is to be processed further. To a special degree, this also makes use of the circumstance that specifically background noise is perceived as less directional, in spatial terms, in low frequency bands, which make a considerable contribution to the basic perception of a hearing situation, owing to the smaller numbers of waves, and hence are even less affected by the adjustment of the preferential direction of the directional characteristic and hence the directional characteristic as such. In particular, this applies to the case in which adjusting the preferential direction of the directional characteristic involves the directional characteristic itself not being altered further, apart from a purely spatial rotation.

Favorably, the preferential direction of the first directional characteristic is adjusted at an angle of between 5° and 20°, preferably between 5° and 10°, in comparison with the preferential direction of the user. To alter the orientation of the directional characteristic, adjustment of the preferential direction in the cited angle range is usually sufficient in order to attain adequate attenuation of the signal component of the user's own speech in the picked-up signal. Owing to the only slight alteration of the preferential direction, however, the perception of background noise in a hearing situation, which background noise has a certain directional dependency, such as e.g. music from a locatable loudspeaker at a distance of several meters, is also not really influenced, which means that the adaptation becomes even less noticeable for a user.

Preferably, the picked-up signal is monitored for a hearing situation having a directional main sound source, wherein without recognition of a speech activity of the user, recognition of a hearing situation having a directional main sound source prompts the preferential direction of the first directional characteristic to be oriented to the frontal direction of the user. A directional main sound source is intended to be understood to mean a sound source that has considerable directional dependency in relation to the sound level of other signal components, and whose sound level lies distinctly above the level of other signal components, regardless of their spatial direction, in the direction of the maximum (for example a loudspeaker box or the like). The frontal direction of the user, which usually essentially corresponds to his line of vision, can be ascertained by further analysis of the picked-up signal in this case, or can be determined by a preset in the hearing device, subject to the orientation of the first directional microphone when the hearing device is worn properly.

If a directional main sound source is now recognized in the hearing situation without the user's own speech activity being recognized at the same time, then it is assumed that the sound from the main sound source is the useful signal for the user, which useful signal is therefore intended to find its way into the picked-up signal at particularly high resolution. In this case, the acoustic resolution—that is to say the signal-to-noise ratio—is achieved by appropriate adaptation of the directional characteristic through adjustment of the preferential direction toward the main sound source.

It is found to be advantageous in this case if the picked-up signal is monitored for a hearing situation corresponding to a conversation, and without recognition of a speech activity of the user, recognition of a hearing situation corresponding to a conversation prompts the preferential direction of the first directional characteristic to be oriented to the frontal direction of the user. A hearing situation corresponding to a conversation, possibly with background noise having little directionality, is a particularly occurrent case for a hearing situation with a main sound source, which in this case is formed by an interlocutor. When such a hearing situation is then first of all recognized, it is assumed that the line of vision of the user is usually in the direction of the interlocutor who is currently active in the user is not himself speaking and hence no speech activity of his own is recognized. Hence, by setting the preferential direction of the directional characteristic in a frontal direction, an efficient improvement in the signal-to-noise ratio can be attained for the speech signal from the interlocutor. This applies particularly when the frontal direction is ascertained not by further analysis of the picked-up signal but rather on the basis of the orientation of the first directional microphone when the hearing device is worn properly.

In a further advantageous refinement, the hearing system contains a further hearing device, particularly a hearing aid. The further hearing device has an associated second directional microphone and the second directional microphone converts sound into a second signal that is adopted in the picked-up signal. The recognition of a speech activity of the user prompts the preferential direction of the second directional characteristic to be adjusted in comparison with a frontal direction of the user such that the second directional characteristic undergoes attenuation in the frontal direction.

In particular, the hearing system is in the form of a binaural hearing system in which the picked-up signal, which adopts the first signal from the at least one hearing device and the second signal from the further hearing device, is used to form a stereo reproduction signal such that production of a first reproduction channel and a second reproduction channel involves the use of signal components from both the first signal and the second signal. In this case, a first reproduction channel can contain firstly only signal components of the first signal, whose directional characteristic is also influenced on the basis of the signal components of the second signal, or can directly include signal components of the first signal and the second signal. In a binaural hearing system, the user's own voice is perceived as coming from the frontal direction on account of the propagation time difference in the signal components of the voice, which difference fails to materialize between the first signal and the second signal, and is amplified as appropriate. For a binaural hearing system, the proposed method can reduce the signal components of the user's own voice in the picked-up signal in a particularly simple manner and without a high level of complexity in the signal processing, no noticeable alterations occurring in the signal level or in background noise picked up from the surroundings.

Preferably, in the binaural hearing system, the first directional microphone and the second directional microphone are respectively formed by a first single microphone in one, in that case the first, hearing device and by a second single microphone in the further, in that case the second, hearing device, wherein in respect of the first directional characteristic and in respect of the second directional characteristic, the signals from the first single microphone and from the second single microphone are processed for one hearing device and the other hearing device separately. In other words, the single microphones of the two hearing devices, namely a left and a right hearing device, are connected up to form a directional microphone. The first and second directional characteristics result from signal processing on the signals from the first and second single microphones that are separate from the two hearing devices. Preferably, the two single microphones have an essentially omnidirectional characteristic. The separate signal processing means that each of the two hearing devices has an associated specific, namely a first, e.g. left, directional characteristic and a second, e.g. right, directional characteristic.

Expediently, the preferential direction of the second directional characteristic is adjusted at an angle of between 5° and 20°, preferably between 5° and 10°, preferably in comparison with the frontal direction of the user. Expediently, the preferential directions of the first directional characteristic and the second directional characteristic are each adjusted in the cited angle range in this case. To alter the orientation of the directional characteristic, adjustment of the preferential direction in the cited angle range is usually sufficient in order to attain adequate attenuation of the signal component of the user's own speech in the picked-up signal. Owing to the only slight alteration of the preferential direction, however, the perception of background noise in the hearing situation, which background noise has a certain directional dependency, such as e.g. music from a locatable loudspeaker at a distance of several meters, is also not really influenced, which means that the adaptation becomes even less noticeable for a user.

It is found to be additionally advantageous if the picked-up signal is monitored for a hearing situation corresponding to a conversation, wherein recognition of a speech activity of an interlocutor prompts the preferential direction of the second directional characteristic to be oriented to the frontal direction of the user. Expediently, the preferential directions of the first directional characteristic and the second directional characteristic are each oriented to the frontal direction of the user in this case. Specifically in the case of a binaural hearing system having a rich spatial sound, this allows particularly good intelligibility of the speech signal from the interlocutor to be attained in the cited hearing situation with little complexity in the signal processing.

Preferably, recognition of a speech activity of the user prompts the preferential directions of the first directional characteristic and the second directional characteristic to be adjusted in comparison with the frontal direction of the user such that the preferential directions of the first directional characteristic and the second directional characteristic are averted from one another. In particular, the adjustment can be made symmetrically in this case, i.e. the preferential direction of the first directional characteristic and the preferential direction of the second directional characteristic are each adjusted by the same angular amount in an outward direction away from the frontal direction. As a result, depending on the directionality in the directional characteristics, a kind of channel is formed between the directional characteristics of the two hearing devices by the averted setting, which channel has reduced sound sensitivity. The sound of the user's own voice propagates in this channel in this case.

Alternatively, recognition of a speech activity of the user prompts the preferential directions of the first directional characteristic and the second directional characteristic to be adjusted in comparison with the frontal direction of the user such that the preferential directions of the first directional characteristic and the second directional characteristic, setting out as vectors from the respective hearing device, intersect one another. In particular, the adjustment is made symmetrically in this case, i.e. the preferential direction of the first directional characteristic and the preferential direction of the second directional characteristic are each adjusted in an inward direction or toward one another by the same angular amount with respect to the frontal direction. Adjustment of the preferential directions of the directional characteristics toward one another reduces the signal component of the user's own voice that is adopted in the picked-up signal by the shadowing effect that the head exerts on the sound of the voice when the directional characteristic is appropriately oriented. In addition, when the directional characteristics cross over, sudden interjections by an interlocutor standing head-on can continue to be captured almost uninfluenced.

It is found to be additionally advantageous if the picked-up signal is broken down into a plurality of frequency bands, and recognition of a speech activity of the user prompts a preferential direction of the first directional characteristic and/or a preferential direction of the second directional characteristic to be adjusted in comparison with the frontal direction of the user in at least one frequency band. If recognition of a speech activity of the user prompts the directional characteristics to be adjusted in comparison with the frontal direction only in those frequency bands either in which an excessive signal component in the picked-up signal is perceived as particularly disagreeable by the user or which have a particularly high level of directionality in the speech signal and hence are particularly simple to be influenced by adjusting the directional characteristic, then it is possible to save resources in the signal processing of the other frequency bands.

The invention further cites a binaural hearing system having two hearing devices, particularly hearing aids, that each have at least one directional microphone that is set up to perform the method described previously. In this case, the advantages specified for the method and the developments thereof could be transferred mutatis mutandis to the binaural hearing system.

Other features which are considered as characteristic for the invention are set forth in the appended claims.

Although the invention is illustrated and described herein as embodied in a method for improving a picked-up signal in a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Each of the corresponding parts and magnitudes are each provided with the same reference symbols throughout the figures.

Figure 1:
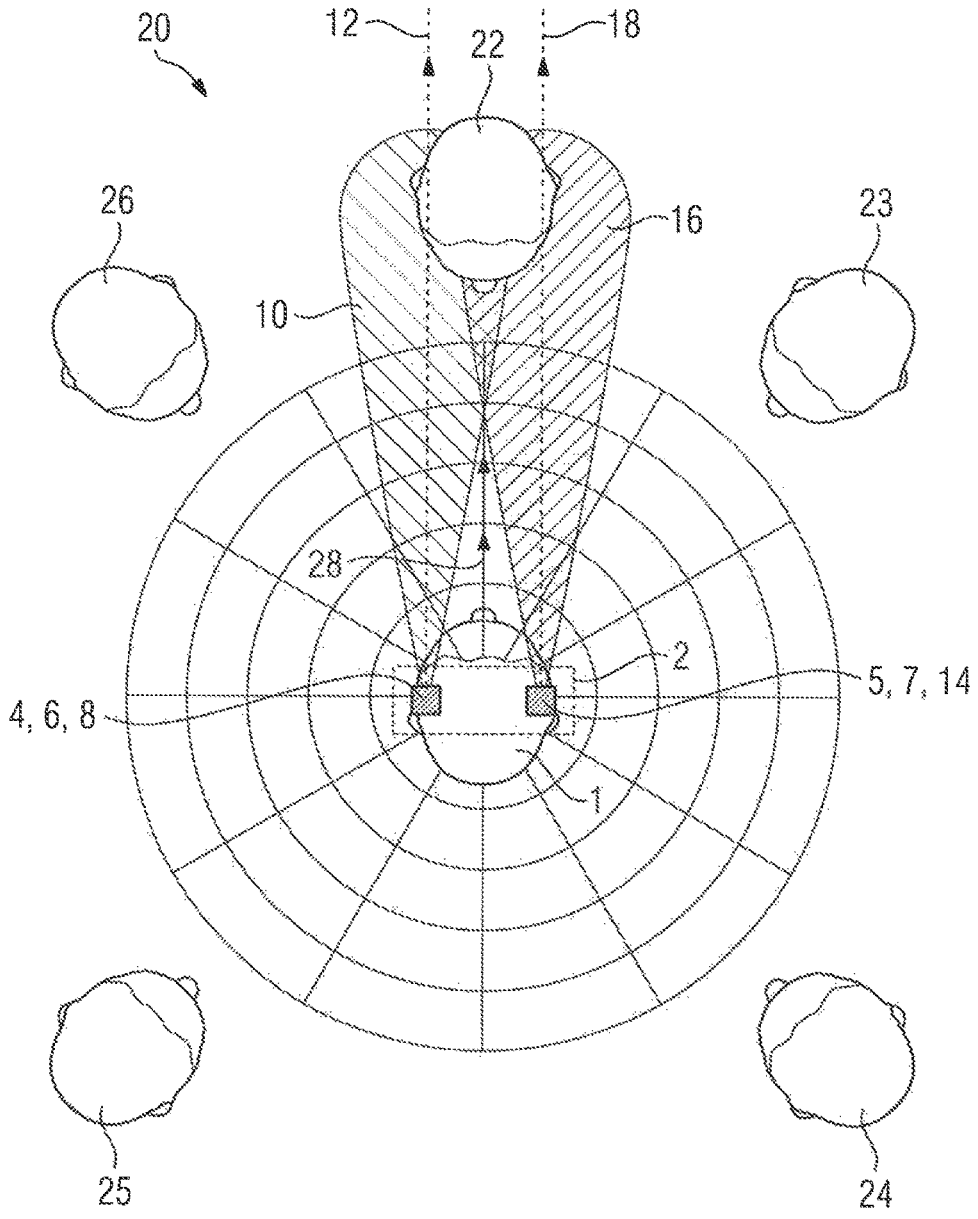
FIG. 1 is diagrammatic, plan view of a user of a binaural hearing system in a hearing situation having multiple interlocutors according to the invention.

Referring now to the figures of the drawings in detail and first, particularly to FIG. 1 thereof, there is shown a schematic plan view of a user 1 of a binaural hearing system 2 that contains two hearing devices 6, 7 in the form of hearing aids 4, 5. The left hearing device 6 has a first directional microphone 8 having a first directional characteristic 10 that is symmetrical with respect to a preferential direction 12. The right hearing device 7 has a second directional microphone 14 having a second directional characteristic 16 that is symmetrical with respect to a preferential direction 18. A hearing situation 20 of the user 1 of the binaural hearing system 2 is provided by a conversation involving interlocutors 22 to 26.

The instantaneous conversation situation is thus such that the user 1 orients his frontal direction 28 (which is provided by the line of vision of the head) toward the interlocutor 22 to allow better listening. If, in the present conversation situation, the interlocutor 22 is now the main protagonist, and if the other interlocutors 23 to 26 make only occasional interjections in this case, then the preferential direction 12 of the first directional characteristic 10 and the preferential direction 18 of the second directional characteristic 16 are oriented in the frontal direction 28 of the user 1, which means that the latter can perceive the speech signal from the interlocutor 22 particularly well via the binaural hearing system 2.

When there is speech activity of the user 1, the sound of his own speech is diffracted around the head such that the sound of his own speech hits each ear and hence each of the two hearing devices 6, 7 essentially from the frontal direction. The frontal perception is furthermore conditional upon the sound of his own speech arriving at both ears without a propagation time difference, so that the symmetrical perception means that there is resultant awareness of a sound hitting head-on. This means that when a first directional characteristic of the first directional microphone 8 and the second directional characteristic 16 of the second directional microphone 14 are each oriented in the frontal direction 28, the sound of the user's 1 own voice is adopted to a special degree in the picked-up signal of the binaural hearing system 2. The gain in the signal processing of the binaural hearing system 2 means that this can lead to the user perceiving his own speech at a disagreeably loud level.

Figure 2:
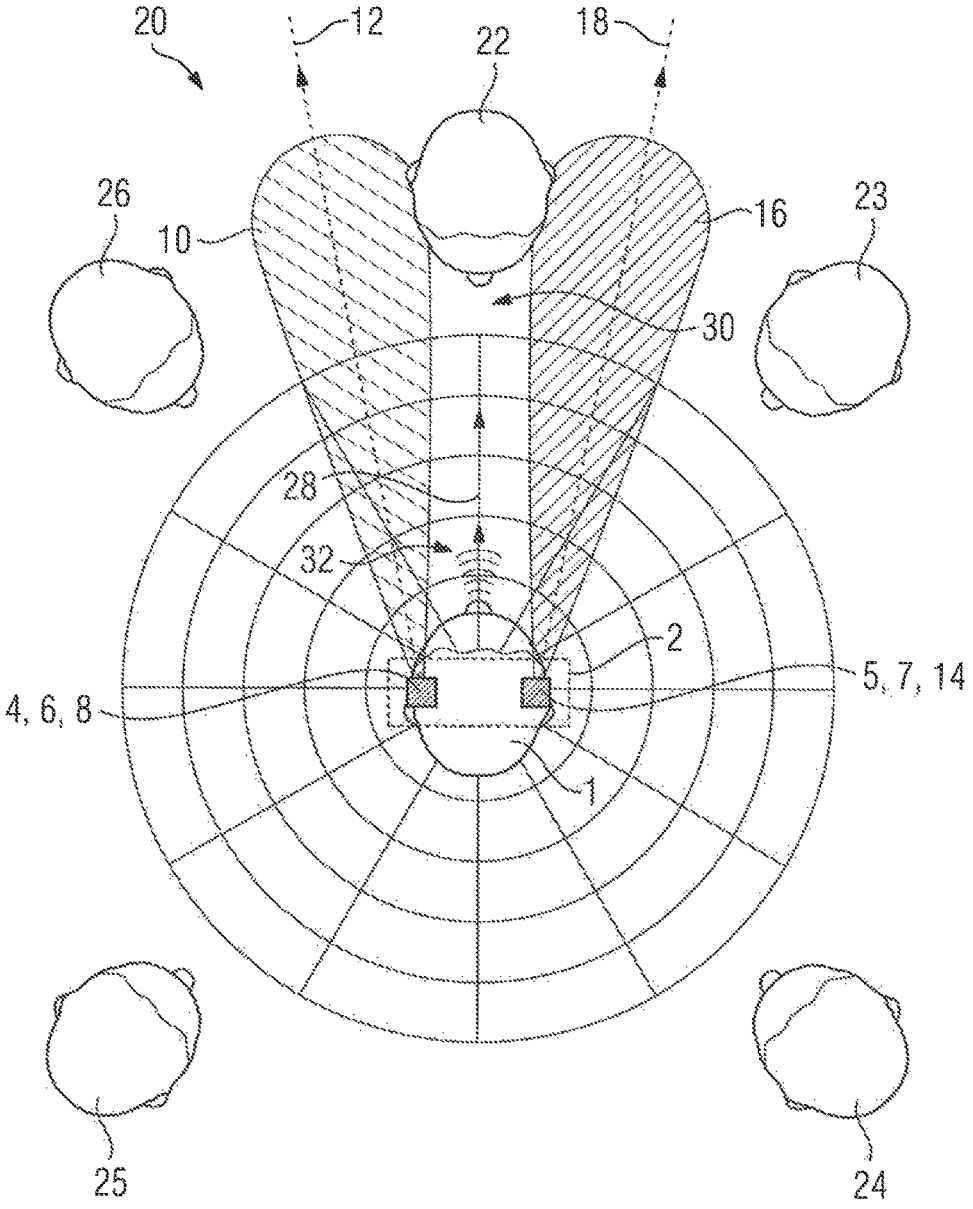
FIG. 2 is a plan view of the directional characteristics of the binaural hearing system shown in FIG. 1 in the case of speech activity of the user.

In order to prevent such perception, the directional characteristics 10, 16 of the two directional microphones 8, 14 of the binaural hearing system 2 are adjusted contrary to the frontal direction 28 when the user 1 himself is speaking. This is shown in FIG. 2. The preferential direction 12 of the first directional characteristic 10 of the first directional microphone 8 is tilted slightly in an outward direction with respect to the frontal direction 28 of the user 1 when there is a speech activity of the latter. The same applies to the preferential direction 18 of the second directional characteristic 16 of the second directional microphone 14. As a result of the preferential directions 12, 18 being adjusted away from the frontal direction 28 of the user 1, the directional characteristics 10, 16 form a kind of channel 30 from the user 1 to the interlocutor 22 in which the sound sensitivity of the binaural hearing system 2 is reduced. In this case, the sound 32 of the user's 1 own speech propagates in this channel 30 first of all and is routed to the directional microphones 8, 14 by diffraction. Since the preferential directions 12, 18, which each represent the direction having the greatest sound sensitivity for the directional characteristics 10, 16, have now been adjusted in comparison with the frontal direction 28 of the user 1, the sound 32 of the user's 1 own speech undergoes slight attenuation in respect of its adoption in a picked-up signal of the binaural hearing system 2.

Figure 3:
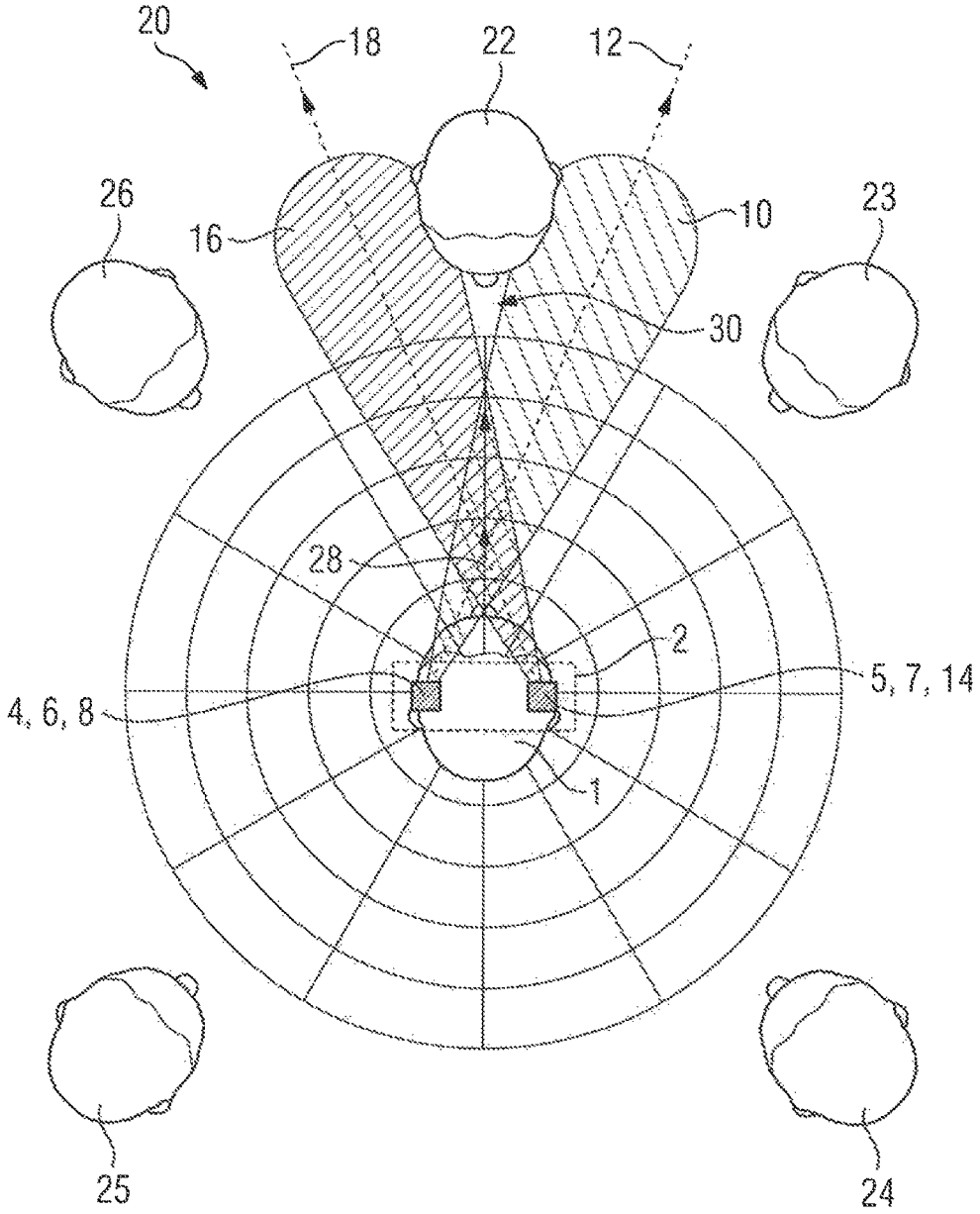
FIG. 3 is a plan view of another possibility for the setting of the directional characteristics of the binaural hearing system shown in FIG. 1 in the case of speech activity of the user.

A further option for the adjustment of the directional characteristics 10, 16 in comparison with the frontal direction 28 of the user 1 for his own speech activity is shown schematically in a plan view in FIG. 3. In this case, the first directional characteristic 10 of the first directional microphone 8 is adjusted not in an outward direction, that is to say away from the frontal direction 28 of the user 1, but rather "inward" toward one another, so that the preferential direction 12 of the first directional characteristic 10 crosses the frontal direction 28. The same applies to the second directional characteristic 16 of the second directional microphone 14, which is adjusted "inward" such that the preferential direction 18 of the second directional characteristic 16 crosses the frontal direction 28 of the user 1.

When there is a speech activity of the user 1, the attenuation of the signal component that is adopted in a picked-up signal of the binaural hearing system 2 occurs primarily as a result of shadowing effects by the head of the user 1. In this case, the directional characteristics 10, 16 are set such that the regions with particularly high sound sensitivity are already partially covered ("shadowed") by the head of the user, so that the sound of the user's 1 own speech that hits the directional microphones 8, 14 head-on also undergoes attenuation thereby in the picked-up signal. The variant presented in this case additionally has the advantage that the interlocutor 22 is still captured well by the directional characteristics 16, 10 of the directional microphones 8, 14, i.e. despite the adjustment of the preferential directions 12, 18, the sound sensitivity of the directional microphones 8, 14 in immediate surroundings of the interlocutor 22 is still good enough, given a standard conversational distance of 0.5 to 1.5 m, to pick up any spontaneous replies and/or interjections by the interlocutor 22 in the picked-up signal of the binaural hearing system 2 as well at a sufficiently high signal level.

Figure 4:
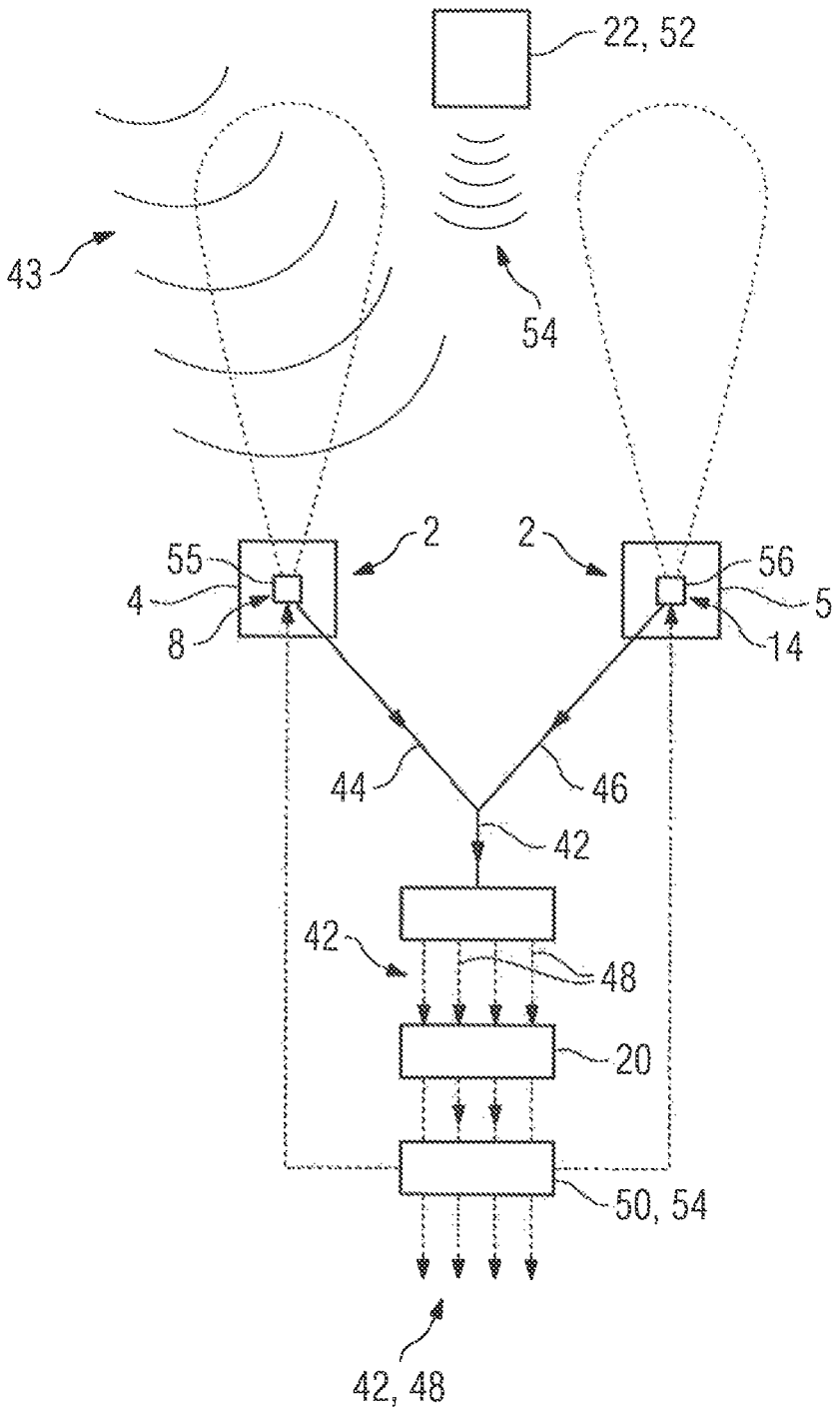
FIG. 4 is a block diagram of the flow of a method for improving a picked-up signal in a binaural hearing system.

FIG. 4 shows a block diagram of the flow of a method 40 for improving a picked-up signal 42 in a binaural hearing system 2. The two directional microphones 8, 14 of the hearing devices 4, 5 produce a first signal 44 and a second signal 46, respectively, from a sound 43, which signals are adopted in the picked-up signal 42. The picked-up signal 42 is broken down into a plurality of frequency bands 48, and the sound levels in the frequency bands 48 and also the correlations in the signal components of the frequency bands 48 are taken as a basis for monitoring for a hearing situation 20 corresponding to a conversation. When this hearing situation 20 is recognized, monitoring of a speech activity 50 of the user is performed in some frequency bands 48. When a speech activity 50 is detected, the first directional characteristic 10 of the first directional microphone 8 and the second directional characteristic 16 of the second directional microphone 14 are adjusted contrary to the frontal direction of the user in the manner described above in individual frequency bands 48 in the picked-up signal that have particularly high signal components from the speech.

If no speech activity 50 is detected, then a prerequisite made for conversation is that the user directs his eyes toward an interlocutor 22, who can be regarded as the main sound source 52 for the given hearing situation 20. In this case, the directional characteristics 10, 16 are oriented in a frontal direction in the manner explained above. This can be effected particularly also on the basis of a speech activity 54 that is recognized for the interlocutor, i.e. adjustment of the directional characteristics 10, 16 in the relevant frequency bands toward the frontal direction is effected only when the signal coming from the direction of the interlocutor 22 has a correspondingly significant level, which means that the speech activity 54 is detected as a result. The picked-up signal 42 formed by the frequency bands 48 can then continue to be handled in accordance with the applications provided for the binaural hearing system 2.

In a preferred variant, the two hearing devices 6, 7 each comprise an essentially omnidirectional single microphone 55 or 56 (see FIG. 4). The two directional microphones 8, 14 are each formed by interconnecting the two single microphones 55, 56 (illustrated by a dashed connecting line in FIG. 4), with the first directional characteristic 10 for the first hearing device 6 and the second directional characteristic 16 for the second hearing device 7 being obtained or resulting from separate signal processing of the signals from the first and second single microphones 55 and 56.

Although the invention has been illustrated and described in more detail by means of the preferred exemplary embodiment, the invention is not restricted by this exemplary embodiment. Other variations can be derived therefrom by a person skilled in the art without departing from the scope of protection of the invention.

The following is a summary list of reference numerals and the corresponding structure used in the above description of the invention:

1 user
2 binaural hearing system
4, 5 hearing aid
6, 7 hearing device
8 first directional microphone
10 first directional characteristic
12 preferential direction
14 second directional microphone
16 second directional characteristic
18 preferential direction
20 hearing situation
22-26 interlocutor
28 frontal direction
30 channel
32 sound of the user's own speech
40 method
42 picked-up signal
43 sound
44 first signal
46 second signal
48 frequency band
50 speech activity of the user
52 main sound source
54 speech activity of the interlocutor
55 single microphone
56 single microphone

The invention claimed is:

1. A method for improving a picked-up signal in a hearing system having at least one hearing device, the at least one hearing aid device containing an associated first directional microphone having an adjustable first directional characteristic with a preferential direction, which comprises the steps of:

converting, via the first directional microphone, sound into a first signal that is adopted in the picked-up signal;

monitoring speech activity of a user of the hearing system;

prompting the preferential direction of the first directional characteristic to be adjusted in comparison with a frontal direction of the user such that sound sensitivity of the first directional microphone undergoes attenuation in the frontal direction in dependence on recognition of the speech activity of the user; and adjusting the preferential direction of the first directional characteristic at an angle of between 5° and 20° in comparison with the frontal direction of the user.

2. The method according to claim 1, which further comprises monitoring the picked-up signal for a hearing situation having a directional main sound source, and wherein without recognition of the speech activity of the user, recognition of the hearing situation having the directional main sound source prompts the preferential direction of the first directional characteristic to be oriented to the frontal direction of the user.

3. The method according to claim 2, which further comprises monitoring the picked-up signal for the hearing situation corresponding to a conversation, and without recognition of the speech activity of the user, recognition of the hearing situation corresponding to the conversation prompts the preferential direction of the first directional characteristic to be oriented to the frontal direction of the user.

4. The method according to claim 1, wherein the hearing system further contains a further hearing device having an associated second directional microphone, the method further comprises:

converting, via the second directional microphone, the sound into a second signal that is adopted in the picked-up signal; and prompting a preferential direction of a second directional characteristic to be adjusted in comparison with the frontal direction of the user such that the second directional characteristic undergoes attenuation in the frontal direction upon recognition of the speech activity of the user.

5. The method according to claim 4, wherein the first directional microphone and the second directional microphone are respectively formed by a first single microphone in the one hearing device and by a second single microphone in the further hearing device, and wherein in respect of the first directional characteristic and in respect of the second directional characteristic, signals from the first single microphone and from the second single microphone are processed for the one hearing device and the further hearing device separately.

6. The method according to claim 4, which further comprises adjusting the preferential direction of the second directional characteristic at an angle of between 5° and 20° in comparison with the frontal direction of the user.

7. The method according to claim 4, which further comprises monitoring the picked-up signal for a hearing situation corresponding to a conversation, and wherein recognition of a speech activity of an interlocutor prompts the preferential direction of the second directional characteristic to be oriented to the frontal direction of the user.

8. The method according to claim 4, wherein upon recognition of the speech activity of the user, prompting the preferential direction of the first directional characteristic and of the second directional characteristic to be adjusted in comparison with the frontal direction of the user such that the preferential direction of the first directional characteristic and of the second directional characteristic are averted from one another.

9. The method according to claim 4, wherein upon recognition of the speech activity of the user, prompting the preferential direction of the first directional characteristic and of the second directional characteristic to be adjusted in comparison with the frontal direction of the user such that the preferential direction of the first directional characteristic and of the second directional characteristic intersect one another.

10. The method according to claim 1, which further comprises breaking down the picked-up signal into a plurality of frequency bands, and upon recognition of the speech activity of the user, prompting the preferential direction of at least one of the first directional characteristic or the preferential direction of the second directional characteristic to be adjusted in comparison with the frontal direction of the user in at least one frequency band.

11. A binaural hearing system, comprising:

two hearing devices each having an associated directional microphone being configured to perform a method according to claim 4.

12. The binaural hearing system according to claim 11, wherein said hearing devices are hearing aids.

13. A method for improving a picked-up signal in a hearing system having at least one hearing device, the at least one hearing aid device containing an associated first directional microphone having an adjustable first directional characteristic with a preferential direction, which comprises the steps of:

converting, via the first directional microphone, sound into a first signal that is adopted in the picked-up signal;

monitoring speech activity of a user of the hearing system;

prompting the preferential direction of the first directional characteristic to be adjusted in comparison with a frontal direction of the user such that sound sensitivity of the first directional microphone undergoes attenuation in the frontal direction in dependence on recognition of the speech activity of the user; and monitoring the picked-up signal for a hearing situation having a directional main sound source, and wherein without recognition of the speech activity of the user, recognition of the hearing situation having the directional main sound source prompts the preferential direction of the first directional characteristic to be oriented to the frontal direction of the user.

14. The method according to claim 13, which further comprises monitoring the picked-up signal for the hearing situation corresponding to a conversation, and without recognition of the speech activity of the user, recognition of the hearing situation corresponding to the conversation prompts the preferential direction of the first directional characteristic to be oriented to the frontal direction of the user.

15. The method according to claim 13, wherein the hearing system further contains a further hearing device having an associated second directional microphone, the method further comprises:

converting, via the second directional microphone, the sound into a second signal that is adopted in the picked-up signal; and prompting a preferential direction of a second directional characteristic to be adjusted in comparison with the frontal direction of the user such that the second directional characteristic undergoes attenuation in the frontal direction upon recognition of the speech activity of the user.

16. The method according to claim 15, wherein the first directional microphone and the second directional microphone are respectively formed by a first single microphone in the one hearing device and by a second single microphone in the further hearing device, and wherein in respect of the first directional characteristic and in respect of the second directional characteristic, signals from the first single microphone and from the second single microphone are processed for the one hearing device and the further hearing device separately.

17. The method according to claim 15, which further comprises monitoring the picked-up signal for a hearing situation corresponding to a conversation, and wherein recognition of a speech activity of an interlocutor prompts the preferential direction of the second directional characteristic to be oriented to the frontal direction of the user.

18. The method according to claim 15, wherein upon recognition of the speech activity of the user, prompting the preferential direction of the first directional characteristic and of the second directional characteristic to be adjusted in comparison with the frontal direction of the user such that the preferential direction of the first directional characteristic and of the second directional characteristic are averted from one another.

19. The method according to claim 15, wherein upon recognition of the speech activity of the user, prompting the preferential direction of the first directional characteristic and of the second directional characteristic to be adjusted in comparison with the frontal direction of the user such that the preferential direction of the first directional characteristic and of the second directional characteristic intersect one another.

20. The method according to claim 13, which further comprises breaking down the picked-up signal into a plurality of frequency bands, and upon recognition of the speech activity of the user, prompting the preferential direction of at least one of the first directional characteristic or the preferential direction of the second directional characteristic to be adjusted in comparison with the frontal direction of the user in at least one frequency band.

* * * * *